United States Patent [19]

Sugiyama

[11] 4,369,753

[45] Jan. 25, 1983

[54] PRESSURE MEDIATED DIESEL ENGINE EXHAUST GAS RECIRCULATION CONTROL SYSTEM

[75] Inventor: Toshihisa Sugiyama, Gotenba, Japan

[73] Assignee: Toyota Jidosha Kogyo Kabushiki Kaisha, Toyota, Japan

[21] Appl. No.: 215,848

[22] Filed: Dec. 12, 1980

[30] Foreign Application Priority Data

Jul. 25, 1980 [JP] Japan ..... 55-102030

[51] Int. Cl.[3] ..... F02M 25/06

[52] U.S. Cl. ..... 123/569; 123/571

[58] Field of Search ..... 123/569, 568, 571

[56] References Cited

U.S. PATENT DOCUMENTS

| | | | |
|---|---|---|---|
| 3,916,857 | 11/1975 | Naito et al. | 123/571 |
| 4,181,109 | 1/1980 | Wake et al. | 123/569 |
| 4,280,470 | 7/1981 | Ueda | 123/569 |
| 4,304,208 | 12/1981 | Etoh et al. | 123/568 |

FOREIGN PATENT DOCUMENTS

| | | | |
|---|---|---|---|
| 2855027 | 7/1980 | United Kingdom | 123/571 |
| 55-5443 | 1/1980 | Japan | 123/569 |

*Primary Examiner*—Wendell E. Burns

*Attorney, Agent, or Firm*—Stevens, Davis, Miller & Mosher

[57] ABSTRACT

A diesel engine includes an air intake system, an exhaust system, and an exhaust gas recirculation conduit which leads from the exhaust system to the intake system. An exhaust gas recirculation control valve, which includes a first diaphragm chamber, is mounted in the exhaust gas recirculation conduit so as to regulate the flow of exhaust gas through it. The exhaust gas recirculation control valve is controlled by a controlling fluid pressure supplied to its first diaphragm chamber. A fluid pressure control valve receives supply of fluid pressure and produces this controlling fluid pressure for the exhaust gas recirculation control valve, according to the amount of displacement of a movable member which moves according to the amount of diesel fuel being supplied to the diesel engine. In a particular embodiment, a throttle valve is fitted to the intake system upstream of the point where the exhaust gas recirculation conduit joins to it, and is moved by a fluid pressure actuated diaphragm device including a second diaphragm chamber which is also supplied with the same controlling fluid pressure as is the first diaphragm chamber. Also, in various constructions, valves or the like for cutting off supply of the controlling fluid pressure to the first and second diaphragm chambers when the temperature of the engine is low, and when the engine revolution speed is high, may be provided. A system may also be provided for, when the engine rotational speed is low, either reducing the value of the controlling fluid pressure, or alternatively for cutting off supply of it to the second diaphragm chamber only.

16 Claims, 8 Drawing Figures

PRESSURE MEDIATED DIESEL ENGINE EXHAUST GAS RECIRCULATION CONTROL SYSTEM

BACKGROUND OF THE INVENTION

The present invention is related to the field of exhaust gas recirculation control systems for internal combustion engines, and more particularly is related to the field of exhaust gas recirculation control systems for diesel engines for automotive vehicles and the like.

Diesel engines generally operate on an over lean mode, i.e. more intake air is sucked in via the intake system of the engine than is required for combustion of the fuel supplied to the combustion chambers thereof by the fuel injectors which are mounted in said combustion chambers. The amount of this sucked in air which is in excess of the amount of air required to burn the fuel is conventionally called the "excess air". It has been conceived, and practiced, to replace a part of this excess air sucked into the intake system of the diesel engine by exhaust gas recycled into the intake system of the engine from its exhaust system, in order to reduce the level of nitrogen oxide pollution in the exhaust gases. This so called exhaust gas recirculation is effective for keeping the levels of pollutants down to reasonable values. In other words, the basic point of exhaust gas recirculation in diesel engines is to replace at least part of the excess air by recycled exhaust gases. For maximum effectiveness in combating emission of harmful pollutants, it is preferable that a certain part of the excess air should be replaced by exhaust gases, so that the exhaust gases of the diesel internal combustion engine may be well purified of nitrogen oxides, and also the engine is inhibited from producing excessive exhaust smoke, and is maintained in a good engine operability condition.

Generally, the excess air ratio of a diesel engine is related with the engine load, i.e., to the amount of diesel fuel being injected per single injection into the combustion chambers of the engine. That is to say, the lower is the engine load, the greater is the excess air ratio; and, conversely, as engine load increases, the excess air ratio decreases. Therefore, in order to conduct the exhaust gas recirculation at a flow rate corresponding to the excess air amount, it is desirable to reduce the exhaust gas recirculation ratio according to increasing engine load. This exhaust gas recirculation ratio is defined as the value produced by dividing the exhaust gas recirculation flow rate by the sum of the exhaust gas recirculation flow rate and the air intake flow rate; i.e., is defined as the ratio of the exhaust gas recirculation flow rate to the total flow rate of gas intake by the combustion chambers of the diesel internal combustion engine.

As mentioned above, in a diesel engine, since the load thereon is effectively controlled by the amount of fuel injected into the combustion chambers thereof through the fuel injectors, and there exists substantially no intake manifold negative pressure within the intake system thereof (any negative pressure present in said intake manifold in any case not being directly correlated with the load on the diesel internal combustion engine), the type of exhaust gas recirculation control valve for gasoline internal combustion engines which is driven by a diaphragm device which is actuated by the intake manifold negative pressure cannot be used for diesel internal combustion engines. Therefore, some other way of relating the opening amount of an exhaust gas recirculation control valve, which controls the effective cross sectional opening area of an exhaust gas recirculation passage which returns a part of the exhaust gases from the exhaust system of the diesel engine to the intake system thereof, to the engine load, is required to be found.

It has previously been conceived, in diesel engines, mechanically to connect a movable member, such as a lever mounted on the valve stem of an exhaust gas recirculation control valve, to a movable part of an accelerator pedal linkage of the vehicle incorporating the diesel engine, or alternatively to a control lever for a fuel injection pump which provides fuel to the fuel injectors of the engine, either of which parts moves according to the amount of fuel per injection being provided to the diesel engine, i.e. according to the load on said engine. This connection has been performed mechanically using wires and links, etc., and thus indirectly drives the exhaust gas recirculation control valve according to the displacement of the above mentioned movable element, i.e. according to the load on the diesel engine. However, there are difficulties with regard to this proposed structure.

First, since the exhaust gas recirculation control valve and the aforesaid movable member are merely directly connected, in the above proposed structure, it is difficult for the performance of variation of the exhaust gas recirculation ratio with respect to the load to be freely chosen, and in fact a wide freedom for choice in said variation performance is very desirable, from the viewpoint of obtaining best operativity and exhaust emission quality from the diesel engine.

Secondly, with such a mechanical structure as proposed above, if it is desired to superpose onto the elementary relationship between the exhaust gas recirculation ratio and the load on the diesel engine a correcting factor related to, for example, the engine rotational speed, or the engine temperature, or the like, then it is not practical to incorporate such a correcting factor in the mechanical linkage, and it becomes necessary, for example, to provide a shut off valve or a flow amount control valve within the exhaust gas recirculation conduit, separately from the exhaust gas recirculation control valve. This is very troublesome, and causes additional cost in producing the system, and also causes unreliability during its operation.

Third, since the pressing of the foot of the driver of the vehicle upon the accelerator pedal thereof is required, in the above proposed construction, not only to actuate the movable member and to control a fuel metering element of the fuel injection pump, but is also required to move the valve element of the exhaust gas recirculation control valve which is mechanically connected thereto, the load upon the accelerator pedal of the vehicle becomes unacceptably heavy, and the driving feeling for the vehicle is deteriorated.

Because of these various problems with regard to exhaust gas recirculation control systems in which the above described movable member is physically mechanically connected to the valve element of the exhaust gas recirculation control valve, up until now such a system has not been usable in practice, and some alternative has been required to be found.

SUMMARY OF THE INVENTION

The primary object of the present invention is to provide a practical and simple structure for an exhaust gas recirculation control system, for a diesel internal combustion engine, in which the exhaust gas is recirculated at an exhaust gas recirculation ratio which properly corresponds to the load upon the diesel internal combustion engine.

A further object of the present invention is to provide such an exhaust gas recirculation control system, in which the performance of variation of the exhaust gas recirculation ratio, with respect to the engine load, may be freely tailored according to design criteria for the operation of the engine.

A further object of the present invention is to provide such an exhaust gas recirculation control system, in which, over the aforementioned performance of variation of the exhaust gas recirculation ratio with regard to engine load, it is simply and easily possible to superpose a correction with regard to various engine operating parameters, such as, for example, engine revolution speed, engine temperature, or the like.

It is a yet further object of the present invention to provide an improved exhaust gas recirculation control system, which does not place a great load upon the accelerator linkage system of a vehicle to which it is fitted, and thereby does not deteriorate the driving feeling of the vehicle.

According to the present invention, these and other objects are accomplished by, for a diesel internal combustion engine comprising: (a) an air intake system; (b) an exhaust system; (c) an exhaust gas recirculation conduit, a first end of which is connected to said exhaust system and a second end of which is connected to an intermediate part of said air intake system, for recirculating exhaust gases from said exhaust system to said air intake system; and (d) a movable member which moves according to the amount of diesel fuel being supplied to said diesel internal combustion engine: an exhaust gas recirculation control system, comprising: (e) an exhaust gas recirculation control valve, comprising a first diaphragm chamber, provided in said exhaust gas recirculation conduit so as to regulate the flow of exhaust gas through said exhaust gas recirculation conduit, whose resistance to flow of exhaust gas varies according to the value of a controlling fluid pressure supplied to said first diaphragm chamber; and (f) a fluid pressure control valve, which regulates a fluid pressure supply and produces said controlling fluid pressure, according to the amount of displacement of said movable member; whereby the amount of exhaust gas recirculation provided by said exhaust gas recirculation control valve is varied according to the amount of diesel fuel being supplied to said diesel internal combustion engine; and, by suitably tailoring the characteristics of said fluid pressure control valve with regard to the output controlling fluid pressure produced for a given amount of displacement of said movable member, the performance of exhaust gas recirculation provided by said exhaust gas recirculation control valve with respect to the amount of diesel fuel being provided to said diesel internal combustion engine may be suitably tailored; and whereby no great driving load need be put upon said movable member, such as would be imposed, if said movable member were directly mechanically coupled to a valve element of said exhaust gas recirculation control valve.

According to such a structure, since the displacement of said movable member is converted by the fluid pressure control valve to said controlling fluid pressure, and this controlling fluid pressure drives said exhaust gas recirculation control valve, by suitably tailoring the performance of the fluid pressure control valve, it is possible for the performance of the exhaust gas recirculation ratio, with respect to varying engine load, to be properly adjusted according to design criteria for the operation of the internal combustion engine. Moreover, since the driving member of such a fluid pressure control valve may be made relatively small and light, such a fluid pressure control valve imposes little load upon the accelerator linkage system of the vehicle to which it is fitted, and accordingly, the driving feeling of the vehicle is not substantially deteriorated.

Further, according to a detailed aspect of the present invention, there may be provided such an exhaust gas recirculation control system as described above, further comprising: (g) a throttle valve fitted to said intake system upstream of said second end of said exhaust gas recirculation conduit; and (h) a fluid pressure actuated diaphragm device, comprising a second diaphragm chamber which is supplied with said controlling fluid pressure from said fluid pressure control valve, which moves said throttle valve according to the value of said controlling fluid pressure; whereby, according to the amount of diesel fuel being provided to said diesel internal combustion engine, said intake system throttle valve is moved so as to throttle said intake system more or less and thereby so as to produce more or less intake system vacuum in the neighbourhood of said second end of said exhaust gas recirculation conduit, whereby exhaust gas recirculation through said exhaust gas recirculation conduit is desirably more or less promoted.

Further, with such a construction, as a further detailed aspect of the present invention, there may be provided such an exhaust gas recirculation control system as detailed above, further comprising a means for cutting off supply of said controlling fluid pressure to said first diaphragm chamber of said exhaust gas recirculation control valve and to said second diaphragm chamber of said fluid pressure actuated diaphragm device, when the temperature of said diesel internal combustion engine is less than a certain specified value, no exhaust gas recirculation being provided by said exhaust gas recirculation control valve, when said first diaphragm chamber of said exhaust gas recirculation control valve is not being provided with supply of said controlling fluid pressure, and said intake system throttle valve being in its widest open position, when said second diaphragm chamber of said fluid pressure actuated diaphragm device is not being provided with supply of said controlling fluid pressure; and, as an alternative or as an addition, said exhaust gas recirculation control system can further comprise a means for cutting off supply of said controlling fluid pressure to said first diaphragm chamber of said exhaust gas recirculation control valve and to said second diaphragm chamber of said fluid pressure actuated diaphragm device, when the rotational speed of said diesel internal combustion engine is greater than a first predetermined value, no exhaust gas recirculation being provided by said exhaust gas recirculation control valve, when said first diaphragm chamber of said exhaust gas recirculation control valve is not being provided with supply of said controlling fluid pressure, and said intake system throttle valve being in its widest open position, when said second diaphragm chamber of said fluid pressure actuated diaphragm device is not being provided with supply of said controlling fluid pressure; and, in this case, it is possible for said exhaust gas recirculation control system further to comprise a means for, when the rotational speed of said diesel internal combustion engine is less than a second predetermined value, reducing the effective value of said controlling fluid pressure which is being supplied to said first diaphragm chamber of said exhaust gas recirculation control valve and to said second diaphragm chamber of said fluid pressure actuated diaphragm device.

Further, as a particular constructional aspect of the present invention, there may be provided an exhaust gas recirculation control system as described initially above, wherein said fluid pressure control valve comprises: (g) a diaphragm assembly; (h) an atmospheric chamber, to which atmospheric air pressure is admitted, defined on one side of said diaphragm assembly; (i) a negative pressure chamber, defined on the other side of said diaphragm assembly; (j) a first compression coil spring, mounted within said negative pressure chamber, one end of which bears against said other side of said diaphragm assembly, while its other end bears against a fixed part of said fluid pressure control valve; (k) a second compression coil spring, mounted within said atmospheric chamber, one end of which bears against said one side of said diaphragm assembly; a negative pressure output port, which opens to said negative pressure chamber, and from which supply of said controlling fluid pressure, which is a negative pressure, is taken; (l) an input port, which opens into said negative pressure chamber, comprising a first valve seat formed within said negative pressure chamber; and (n) a spring support member, which is movable in the axial direction of said second compression coil spring, and against which said other end of said second compression coil spring bears; said diaphragm assembly comprising: (o) a diaphragm; and (p) a communicating valve mounted on said diaphragm assembly and opposing said first valve seat formed on said negative pressure input port, and movable towards and away from said first valve seat by the flexing of said diaphragm; said communicating valve, when said communicating valve contacts said first valve seat, blocking said negative pressure input port and interrupting communication between said negative pressure input port and said negative pressure chamber, while said communicating valve simultaneously establishes communication between said negative pressure chamber and said atmospheric chamber; and said communicating valve, when said communicating valve is brought out of contact with said first valve seat formed on said negative pressure input port, interrupting communication between said negative pressure chamber and said atmospheric chamber, while said communicating valve simultaneously establishes communication between said negative pressure input port and said pressure chamber; said fluid pressure supply, which is a supply of negative pressure, being provided to said negative pressure input port; a value of negative pressure being established in said negative pressure chamber by said communicating valve being repeatedly brought into and out of contact with said first valve seat formed on said negative pressure input port, by the balance between the pressure difference within said negative pressure chamber and said atmospheric chamber, and the compression actions of said first and second compression coil springs, according to the position of said other end of said second compression coil spring; whereby, as said spring support member is moved in the longitudinal direction of said second compression coil spring, said negative pressure value within said negative pressure chamber is varied.

Thus, it is seen that it is possible to simply and economically, in addition to the basic control provided according to the above described exhaust gas recirculation control system, provide a corrective or subsidiary control function, according to various parameters of the internal combustion engine which make it desirable to modify the above described basic control of exhaust gas recirculation ratio.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

Figure 1:
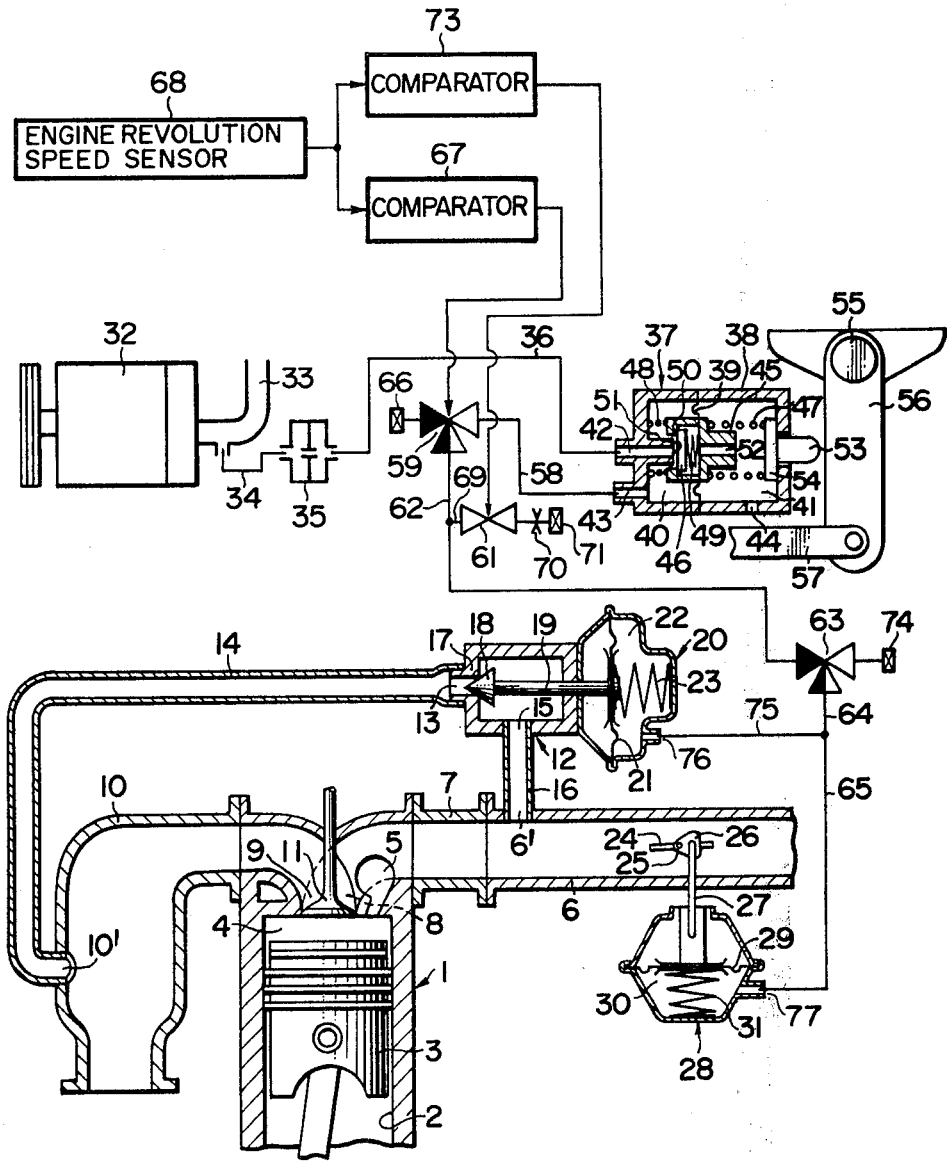
FIG. 1 is a simplified part cross sectional part block diagrammatical schematic structural view, showing a first preferred embodiment of the exhaust gas recirculation control system for a diesel engine, according to the present invention, and also showing part of the diesel engine to which it is fitted, in which the driving member of a negative pressure control valve comprised therein is driven by bearing against an accelerator pedal linkage, and a switching valve selectively admits atmospheric air into a negative pressure conduit thereof, when engine revolution speed is below a certain predetermined value.

Referring to FIG. 1, the diesel engine schematically shown therein incorporates an exhaust gas recirculation control system according to a first preferred embodiment of the exhaust gas recirculation control system for a diesel engine according to the present invention. In this figure, the reference numeral 1 denotes a diesel engine, which comprises a cylinder bore 2 within which there reciprocates, up and down in the drawing, a piston 3. Above the piston 3 in the drawing there is defined, by the cooperation of said cylinder bore 2 and said piston 3, a combustion chamber 4. Into this combustion chamber 4 there opens a vortex chamber 5 which is only schematically shown. In the vortex chamber 5, in fact, there is fitted the end of a fuel injection nozzle, through which liquid diesel fuel in droplet form is periodically injected, at an appropriate timing point during the reciprocating movement of the piston 3 within the bore 2, in a per se well known fashion. The fuel injection nozzle is not shown in the figure. The diesel engine 1 sucks in air into the combustion chamber 4 through an intake take 6, an intake manifold 7, and an intake port 8 which is controlled by an intake poppet valve which is not shown in the drawing, and blows out exhaust gases from the combustion chamber 4, past an exhaust poppet valve 11 and through an exhaust port 9, into an exhaust manifold 10. The intake port 8 lies directly behind the exhaust port 9 in the drawing, and accordingly the poppet valve for controlling the intake port 8 is not visible, because it lies, in the drawing, directly behind the poppet valve 11 for controlling the exhaust port 9.

The reference numeral 12 denotes an exhaust gas recirculation control valve. An intake port 13 of the exhaust gas recirculation control valve 12 is connected, via an exhaust gas conduit 14, to an exhaust gas take off port' provided in the exhaust manifold 10 of the diesel engine 1. An outlet port 15 of the exhaust gas recirculation control valve 12 is connected to an exhaust gas injecting port 5' provided in the intake tube 6, via an exhaust gas injecting conduit 16.

The degree of communication between the exhaust gas intake port 13 and the exhaust gas outlet port 12 of the exhaust gas recirculation control valve 12 is controlled by a valve element 18 in cooperation with a valve seat 17 formed at the inside periphery of the exhaust gas intake port 13. The valve element 18 is mounted on a valve rod 19 which is slidable to the left and to the right in the figure. The right hand end in the figure of this valve rod 19 is connected to a diaphragm 21 of a diaphragm actuated device 20. In the diaphragm actuated device 20, a diaphragm chamber 22 is defined to the right of the diaphragm 21, and a compression coil spring 23 is mounted within this diaphragm chamber 22 so as to bias the diaphragm 21 in the leftwards direction in the drawing. Negative pressure, in this embodiment, is selectively fed to the diaphragm chamber 22 of the diaphragm actuated device 20 through a negative pressure conduit 75 which leads to an input port 76 of said diaphragm actuated device 20, and when so supplied biases the diaphragm 21 of the diaphragm actuated device 20 and the valve rod 19 and the valve element 18 attached thereto to the rightwards direction in the drawing, so as to move the valve element 18 away from the valve seat 17, and thereby so as more fully to open the intake port 13 of the exhaust gas recirculation valve 12, i.e., so as to increase its effective opening cross sectional area.

In an intermediate position within the intake tube 6 of the diesel internal combustion engine 1 there is mounted an intake throttle valve 24, upstream of the exhaust gas injection port 6' from the point of view of the intake air flow. This intake throttle valve 24 is constructed as a butterfly valve which is supported by and is rotatable around the axis of a valve stem 25. To the valve stem 25 there is mounted a butterfly valve drive lever 26, which is connected, via a valve actuating rod 27, to a diaphragm 29 of a second diaphragm actuated device 28.

The diaphragm actuated device 28 comprising the diaphragm 29 defines within its lower portion in the drawing a diaphragm chamber 30, within which there is provided a compression coil spring 31 which biases the diaphragm 29 and the valve actuating rod 27 upwards in the drawing, so as to rotate the intake throttle valve 24 counterclockwise in the drawing and so as to increase the effective opening cross sectional area, i.e. so as to decrease the flow resistance, of the intake passage 6. Negative pressure, in this embodiment, may selectively be supplied to the diaphragm chamber 30 of the second diaphragm actuated device 28 through a port 77 thereof from a negative pressure conduit 65, and when so supplied sucks the diaphragm 29 downwards in the drawing so as to move the valve actuating rod 27 downwards in the drawing and so as thus to rotate the drive lever 26 and the intake throttle valve 24 in the clockwise direction, so as to decrease the effective cross sectional opening area, i.e. so as to increase the flow resistance, of the intake tube 6.

Now the arrangements for supplying actuating negative pressure, via the negative pressure conduits 65 and 75, for the first and second diaphragm actuated devices 20 and 28, will be described. The reference numeral 32 denotes, in this embodiment, a negative pressure pump driven by the rotation of the diesel engine 1. Negative pressure produced by this negative pressure pump 32 is supplied to a vacuum servo unit of a power brake system, not shown in the drawings, through a conduit 33, and optionally is also supplied to other negative pressure operated devices of the vehicle incorporating this diesel internal combustion engine, and is also supplied to a negative pressure control valve 37 via a negative pressure conduit 34, a throttling device 35, and a negative pressure conduit 36.

The function of the negative pressure control valve 37 is to modify the negative pressure supplied to it via the conduit 36 into a controlling negative pressure value for supply to the first diaphragm actuated device 20 and to the second diaphragm actuated device 28, according to the amount of fuel currently being supplied to the fuel injecting system of the diesel engine 1, i.e. according to the load on said diesel internal combustion engine 1. The negative pressure supplied via the negative pressure conduit 36 to the negative pressure control valve 37 is fed to its negative pressure input port 42, and the output negative pressure therefrom, modulated in the above described fashion, is outputed from its negative pressure output port 43. From the negative pressure output port 43, this modulated negative pressure for controlling the first diaphragm actuated device 20 and the second diaphragm actuated device 28 is conducted through a system of conduits and of cut off devices which are switched according to various operating conditions of the vehicle, as will be explained later. The construction and the operation, in this embodiment, of the negative pressure control valve 37 will now be explained.

The negative pressure control valve 37 comprises a casing 38, an internal space defined within which is partitioned by a diaphragm 39. The negative pressure input port 42 and the negative pressure output port 43 open into a pressure chamber 40 defined generally on the left side of the diaphragm 39 in the drawing, and an atmosphere relief port 44 opens into an atmospheric chamber 41 defined generally on the right of the diaphragm 39 in the drawing, said atmospheric chamber 41 being thus always substantially at atmospheric pressure. The diaphragm 39 supports a valve shell member 45. A compression coil spring 47 biases the valve shell member 45 and the diaphragm 39 leftwards in the drawing, and another compression coil spring 48 biases the valve shell member 45 and the diaphragm 39 rightwards in the drawing. The valve shell member 45 is pierced with a through hole 52, which therefore communicates the atmospheric chamber 41 with the pressure chamber 40, but the communication via this through hole 52 is controlled by a valve element 46, which is mounted within the valve shell member 45, and which is biased in the leftwards direction therein by a compression coil spring 49 which bears against the valve shell member 45, said valve element 46 being thereby biased against a valve seat 50 formed at the left hand end in the drawing of the valve shell member 45. Thereby, when this valve element 46 is not pushed away from the valve seat 50, it blocks communication via the through hole 52 through the valve shell member 45, and accordingly interrupts communication at this time between the atmospheric chamber 41 and the pressure chamber 40. On the other hand, when this valve element is pushed away from the valve seat 50, in such circumstances as will be seen later, thereby communication is established via the through hole 52 between the atmospheric chamber 41 and the pressure chamber 40.

Into the pressure chamber 40 there projects a tubular projection 51, the open end of which functions as a valve seat against the valve element 46, when the valve element 46 abuts against the tubular projection 51. Accordingly, when the valve shell member 45 is moved leftwards past a certain position in its travel in the horizontal direction in the drawing, thereby the tubular projection 51 lifts the valve element 46 away from the valve seat 50, against the biasing compression force of the compression coil spring 49 which is overcome, and at the same time the open end of this tubular projection 51 is blocked, and thus in this condition the negative pressure intake port 42 is isolated from the pressure chamber 40, while the pressure chamber 40 is communicated with the atmospheric chamber 41. On the other hand, when the valve shell member 45 moves in the rightward direction past the aforementioned certain position, then the valve element 46 contacts sealingly the valve seat 50 and ceases to abut against the end of the tubular projection 51, and in this condition the negative pressure intake port 42 is communicated with the pressure chamber 40, while on the other hand the pressure chamber 40 is not communicated with the atmospheric chamber 41.

The valve shell member 45 and the diaphragm 39 move leftwards and rightwards in the drawing under the effects of three forces: (a) the spring force exerted in the righwards direction in the drawing by the compression coil spring 48, which does not vary with time; (b) the force exerted in the leftwards direction in the drawing by the pressure difference between the pressure chamber 40, which is at a certain negative pressure, and the atmospheric chamber 41, which is always substantially at atmospheric pressure, as explained above, acting on the area of the diaphragm 39; and (c) the spring force exerted in the leftwards direction in the drawing by the compression coil spring 47, which varies, as will be explained below, according to the position of an accelerator pedal link 56. With a given force being exerted by the compression coil spring 47, therefore, since the apparatus is no designed that the compression force of the compression coil spring 48 is generally stronger than that of the compression coil spring 47, when negative pressure is supplied to the negative pressure input port 42 via the aforesaid throttling means 35 and the negative pressure conduit 36 from the negative pressure pump 32, then the pressure in the pressure chamber 40 will be decreased, and in accordance with this the diaphram 39 and the valve shell member 45 attached thereto will move leftwards in the drawing, maintaining a position which is determined by the balance of the above said three forces, until, when the pressure in the pressure chamber 40 is reduced to a certain critical level, the valve element 46 is brought into abutting contact against the end of the tubular projection 51. As soon as this happens, supply of further negative pressure into the pressure chamber 40 is prevented, by the valve element 46 blocking the opening in the end of the tubular projection 51, and further the pressure within the pressure chamber 40 is now increased by the admission of atmospheric air into said pressure chamber 40 from the atmospheric chamber 41 through the hole 52 and past the valve element 46, between said valve element 46 and the valve seat 50 from which said valve element 46 has become now somewhat displaced. Thereby, the force acting in the leftwards direction due to the difference in pressures between the pressure chamber 40 and the atmospheric chamber 41 is lessened, and in accordance with this the diaphragm 39 and the valve shell member 45 move rightwards in the drawing so as to disengage the valve element 46 from its abutting contact against the end of the tubular projection 51, and so as again to engage said valve element 46 to the valve seat 50. This cycle of operations is repeated again and again, and, as will be clear to one skilled in the art, based upon the foregoing explanation, will result in a certain predetermined value of negative pressure being maintained in the pressure chamber 40, and being supplied therefrom to the negative pressure output port 43.

However, this predetermined value of negative pressure depends upon the compression force of the compression coil spring 47, and this is varied as will now be explained. The left hand end in the figure of the compression coil spring 47 bears upon the valve shell member 55, and the right hand end of the compression coil spring 47 bears upon a flange 54 formed at the left hand end of a plunger 53, the other end of which projects outwards to the right in the drawing from the negative pressure control valve 37. The plunger 53 is slidable within the body of the negative pressure control valve 37, leftwards and rightwards in the drawing, i.e. in the axial direction of the compression coil spring 47, and therefore, as said plunger 53 is moved leftwards in the drawing, the compression force of the compression coil spring 47 is progressively increased; and, conversely, as said plunger 53 is moved rightwards in the drawing, the compression force of the compression coil spring 47 is progressively decreased. Thereby, as will be clear to one skilled in the art, when the plunger 53 is moved leftwards in the drawing, this causes the amount of negative pressure which is required to be present within the pressure chamber 40 in order to attract the valve shell member 45 and diaphragm 49 leftwards in the drawing sufficiently just to contact the valve element 46 to the end of the tubular projection 41, against the compression force of the compression coil spring 48, to become less; and, conversely, when the plunger 53 is moved rightwards in the drawing, this causes said amount of negative pressure to become greater. In other words, the more the plunger 53 is moved to the left in the drawing, the lower or smaller is the balance value of negative pressure present at the negative pressure output port 43; and, conversely, the more that the plunger 53 is moved to the right in the drawing, the greater or larger is the balance value of negative pressure present at said negative pressure output port 43.

Figure 2:
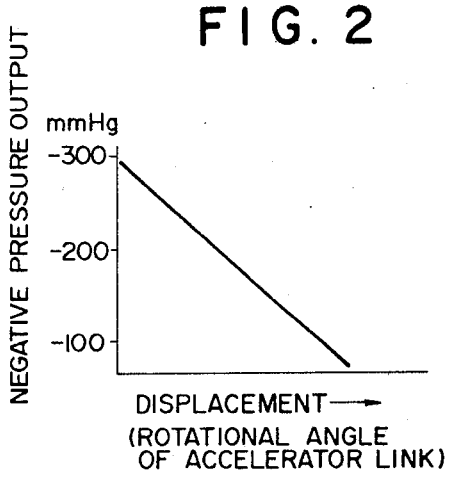
FIG. 2 is a graph, in which negative pressure is the ordinate, and position is the abscissa, and showing the performance of the negative pressure output of the negative pressure control valve in the first preferred embodiment of the exhaust gas recirculation control system for a diesel engine according to the present invention shown in FIG. 1, with respect to the displacement of the above mentioned accelerator pedal linkage.

This relationship is shown diagrammatically in FIG. 2. In this figure, the negative pressure present at the negative pressure output port 53 is shown as the ordinate, and the amount of displacement of the plunger 53 leftwards from its rightmost position, as shown in the drawing, is shown as the abscissa. It will be clear to one of ordinary skill in the art, based upon the above explanation, that an effectively linear relationship exists between these two quantities, said linearity being based upon the linearity of the compression forces of the compression coil springs 47 and 48 with respect to their extensions, and that, as the displacement of the plunger 53 leftwards in the drawing increases, the negative pressure present at the negative pressure output port 43 will decrease.

The right hand end in the drawing of the plunger 53 is contacted to and abutted against an accelerator pedal link 56 so as to be driven thereby. The accelerator pedal link 56 is pivotally supported on a pivot 55 at its upper end in the drawing, and is drivingly connected to the accelerator pedal of the vehicle incorporating the shown diesel engine and exhaust gas recirculation control system according to the first preferred embodiment of the present invention, so as to be rotated in the clockwise direction in the drawing as the accelerator pedal is progressively depressed. The accelerator pedal link 56 is pivotally connected to a rod 57 at its lower end in the drawing, and this rod 57 is connected to a control lever of a fuel injection pump, not shown in the figures, which provides fuel to the fuel injectors of the diesel engine 1 in an amount, per injection stroke, corresponding to the position of its aforesaid control lever.

Accordingly, as the accelerator pedal of the vehicle is more and more depressed by the driver thereof, the accelerator pedal link 56 is rotated more and more in the clockwise direction in the drawing, via the rod 57, and provides more and more fuel per injection stroke from the fuel injection pump (not shown), while at the same time, in proportion to said action, the right hand end in the drawing of the plunger 53 is pushed more and more to the left against the compression force of the compression coil spring 47, and accordingly as explained above the negative pressure present at the negative pressure output port 43 becomes progressively less. As mentioned above, the amount of fuel supplied to the diesel engine 1 is, in this application of the present invention, taken as a parameter representative of the load upon the diesel engine 1.

The negative pressure appearing at the output port 43 of the negative pressure control valve 37 is conducted through a negative pressure conduit 58 to a first negative pressure switching valve 59. If and when transmitted through this first negative pressure switching valve 59, said negative pressure is then transmitted through a conduit 62 to a second negative pressure switching valve 63, and, if and when transmitted through said second negative pressure switching valve 63, it is transmitted through a conduit 64 to the aforementioned conduits 75 and 65 which lead, respectively, to the diaphragm chamber 22 of the first diaphragm actuated device 20 which operates the exhaust gas recirculation control valve 12, and to the diaphragm chamber 30 of the second diaphragm actuated device 28 which operates the intake throttle valve 24, as explained above. Further, from an intermediate portion of the negative pressure conduit 62 there branches off a conduit 69 which leads to a third negative pressure switching valve 61, the other side of which is connected via a throttling means 70 to an air filter 71 which is relieved to the atmosphere.

Accordingly, the negative pressure present at the output port 43 of the negative pressure control valve 37 is provided to the first and second diaphragm chambers 22 and 30 of the first and second diaphragm actuated devices 20 and 28, but this supply may be interfered with by any of the first, the second, and the third negative pressure switching valves 59, 63, and 61, according to various operational conditions of the diesel internal combustion engine 1 and/or the vehicle incorporating it. The operation of these first, second, and third negative pressure switching valves 59, 63, and 61, and the circumstances in which they are switched to conduct or to intercept fluid flow, in the shown first preferred embodiment of the exhaust gas recirculation contol system according to the present invention, will now be described.

An engine revolution speed sensor 68 detects the engine rotational speed (i.e., rpm) and the detected value is fed to a first comparator 67 and to a second comparator 73. The first comparator 67 receives the signal from the engine revolution speed sensor 68 and produces an energization output signal when and only when said engine revolution speed is greater than a certain first predetermined value, which in the present embodiment is approximately 2800 rpm. The second comparator 73 receives the engine revolution speed signal from the engine revolution speed sensor 68 and produces an energization output signal when and only when said engine revolution speed drops below a certain second predetermined value, which is this embodiment is approximately 1200 rpm.

The output of the first comparator 67 is fed to and controls the first negative pressure switching valve 59. The first negative pressure switching valve 59 comprises a solenoid, not shown, and is so constructed that when said solenoid is not supplied with actuating electrical energy the negative pressure conduit 58 is connected to the negative pressure conduit 62; while on the other hand when said solenoid is supplied with actuating electrical energy the negative pressure conduit 62 is connected to a conduit which connects to an air filter 66 which vents it to the atmosphere. Accordingly, the negative pressure present at the output port 43 of the negative pressure control valve 37 is transmitted via the negative pressure conduit 58 through the first negative pressure switching valve 59 to the negative pressure conduit 62 when and only when the engine revolution speed is less than 2800 rpm.

The third negative pressure switching valve 61 is supplied with and is controlled by the output signal of the second comparator 73, and comprises a solenoid, not shown, which, when it is supplied with actuating electrical energy, connects the conduit 69, via the throttling element 70, to the air filter 71 which vents it to the atmosphere with a certain flow resistance; and which, when it is not supplied with actuating electrical energy, shuts off the conduit 69 from communication via the throttling element 70 to the air filter 71 and to the atmosphere. Accordingly, when the engine revolution speed is greater than 1200 rpm, then the negative pressure present within the negative pressure conduit 62 (if such there be) is not interfered with, because the third negative pressure switching valve 61 is closed; but, on the other hand, when the engine revolution speed is less than 1200 rpm, then the negative pressure present within the negative pressure conduit 62 is diluted by a certain amount of atmospheric air which is sucked in through the throttling element 70, through the third negative pressure switching valve 61 which is open, and through the conduit 69 so as to be introduced into said intermediate part of the negative pressure conduit 62.

A second negative pressure switching valve 63 comprises a thermostat, which is not shown, which senses the temperature of the cooling water of the diesel engine 1. When this water temperature is greater than a certain predetermined value, the second negative pressure switching valve 63 communicates the negative pressure conduit 62 to the negative pressure conduit 64, while on the other hand when said water temperature is less than said certain predetermined value said second negative pressure switching valve 63 communicates the negative pressure conduit 64 to the atmosphere via an air filter 74. Accordingly, if the temperature of the cooling water of the diesel internal combustion engine 1 is less than said certain predetermined value, then air at atmospheric pressure is continuously supplied into the first diaphragm chamber 22 of the first diaphragm actuated device 20 and the second diaphragm chamber 30 of the second diaphragm actuated device 28; while, on the other hand, if the temperature of the cooling water of the diesel internal combustion engine 1 is greater than said certain predetermined value, the negative pressure present within the negative pressure conduit 62, if such there be, is communicated to the diaphragm chamber 22 of the first diaphragm actuated device 20 and to the diaphragm chamber 30 of the second diaphragm actuated device 28, via the negative pressure conduit 64, and the negative pressure conduit 75 or the negative pressure conduit 65 respectively.

The exhaust gas recirculation control system described above according to the first preferred embodiment of the present invention operates as follows.

When the revolution speed of the diesel internal combustion engine 1 is greater than 1200 rpm, and is less than 2800 rpm, and the temperature of the cooling water of said diesel internal combustion engine 1 is greater than the specified value, since as explained above the first negative pressure switching valve 59 in this condition is communicating the conduits 58 and 62, and the third negative pressure switching valve 61 is not in the communicating condition, and the second negative pressure switching valve 63 is communicating the negative pressure conduit 62 with the conduit 64, then in this condition the diaphragm chambers 22 and 30 of the first and second diaphragm actuated devices 20 and 28 are receiving supply of negative pressure from the negative pressure output port 43 of the negative pressure control valve 37. Since, as explained above, the negative pressure control valve 37 produces a negative pressure at its output port 43 which varies corresponding to the rotational angle of the accelerator pedal link 56, i.e., substantially corresponding to the load on the diesel internal combustion engine 1, thereby the diaphragm chamber 22 of the first diaphragm actuated device 20 and the diaphragm chamber 30 of the second diaphragm actuated device 28 receive supply of a negative pressure which approximately corresponds to the current engine load. Thereby, the valve element 18 is driven by the first diaphragm actuated device 20, and the intake throttle valve 24 is driven by the second diaphragm actuated device 28, according to the engine load; and, as the engine load increases, i.e., as the aforesaid value of the actuating negative pressure for the first and second diaphragm actuated devices 20 and 28 decreases, in accordance therewith the effective cross sectional opening area of the exhaust gas recirculation control valve 12 decreases, while the effective cross sectional opening area of the intake pipe 6 increases. Thereby, the exhaust gas recirculation ratio is decreased along with increasing engine load.

Figure 3:
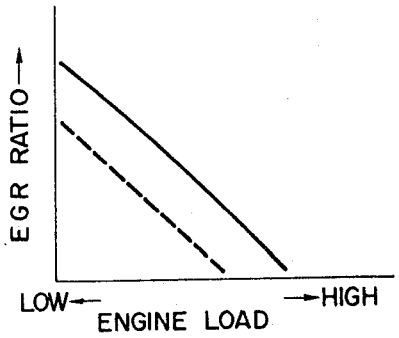
FIG. 3 is a graph, in which exhaust gas recirculation ratio is the ordinate, and engine load is the abscissa, showing the performance of exhaust gas recirculation ratio with respect to engine load, according to the first preferred embodiment of the exhaust gas recirculation control system for a diesel engine according to the present invention shown in FIG. 1.

In FIG. 3, in which exhaust gas recirculation ratio is shown as the ordinate, and engine load is shown as the abscissa, the relation between the exhaust gas recirculation ratio and the engine load, in the above mentioned intermediate revolution speed condition when the diesel engine revolution speed is between 1200 and 2800 rpm and the cooling water of the diesel engine is warm, is shown by the solid line.

When the load on the diesel internal combustion engine 1 is low, if the intake throttle valve 24 were not provided within the intake pipe 6 and controlled by the second diaphragm actuated device 28, as in the shown first preferred embodiment, then, even though at this time the exhaust gas recirculation control valve 12 were very wide open, and presented a large effective cross sectional opening area, the negative pressure present in the vicinity of the exhaust gas injection port 6' within the intake pipe 6 might not be sufficient to suck a proper amount of exhaust gases from the exhaust manifold 10 through the exhaust gas conduit 14 and through the exhaust gas recirculation control valve 12. However, because this intake throttle valve 24 is provided and at times of low engine load, as explained above, is partially closed so as to decrease the effective cross sectional opening area of the intake pipe 6, thereby the negative pressure present within this intake pipe 6 in the vicinity of the exhaust gas injection port 6', downstream of the intake throttle valve 24, is raised to a sufficiently high value to ensure that a proper amount of exhaust gases is recirculated through the exhaust gas recirculation conduit 14 and through the exhaust gas recirculation control valve 12.

On the other hand, when the engine revolution speed is below 1200 rpm, and the temperature of the cooling water of the diesel internal combustion engine 1 is higher than the aforesaid specified value, then, as before, the first negative pressure switching valve connects the negative pressure conduit 58 to the conduit 62, and the second negative pressure switching valve 63 connects the conduit 62 to the conduit 64, but, at this time, the third negative pressure switching valve 61 is open, and accordingly vents an intermediate part of the negative pressure conduit 62 to atmosphere through the throttling element 70 and the filter 71. In this condition, the negative pressure produced at the output port 43 of the negative pressure control valve 37 is transmitted, as before, via the conduit 58, the first switching valve 59, the conduit 62, the second switching valve 63, the conduit 64, and the conduits 75 and 65 respectively to the diaphragm chamber 22 of the first diaphragm actuated device 20 and to the diaphragm chamber 30 of the second diaphragm actuated device 28; but this negative pressure is somewhat diluted or attenuated by the atmospheric air which is admitted into the conduit 62 past the throttling element 70 through the third negative pressure switching valve 61. Thus, because the negative pressure present within the diaphragm chambers 22 and 30 of the first and second diaphragm actuated devices 20 and 28 is attenuated, as described above, thereby the effective cross sectional opening area of the exhaust gas recirculation control valve 12 is somewhat less than it was in the previously described case, when the engine revolution speed was between 1200 rpm and 2800 rpm, for the same engine load, and correspondingly the effective cross sectional opening area of the intake pipe 6, as regulated by the intake throttle valve 24, is somewhat greater than it was in the above mentioned previous case when the engine revolution speed was between 1200 rpm and 2800 rpm, for the same engine load. Accordingly, as a whole, the exhaust gas recirculation ratio is less, in this case, than it was in the previous case when the engine revolution speed is between 1200 rpm and 2800 rpm, for the same engine load.

Thus, the exhaust gas recirculation ratio performance with respect to the engine load now is as shown by the dashed line in FIG. 3; in other words, less exhaust gas recirculation is provided, than was provided in the previous circumstances in which the engine revolution speed was between 1200 rpm and 2800 rpm.

The reason for doing this is as follows. In a diesel internal combustion engine which uses a diesel fuel injection pump of a per se well known sort which is equipped with a governor, for a given position of the accelerator pedal link and the control lever of the fuel injection pump which is connected thereto, the slower is the revolution speed of the diesel internal combustion engine 1, the greater is the amount of fuel provided in each fuel injection spurt by the fuel injection pump. Accordingly, the excess air ratio is lower with lower engine revolution speed. Therefore, in order to attain the twin goals of properly purifying the exhaust gases of the diesel internal combustion engine with regard to nitrogen oxides and also unburnt hydrocarbons, and also of providing general good engine operativity and drivability, the exhaust gas recirculation ratio must be reduced when engine revolution speed is low, from what it should be otherwise, for a given engine load. This is the reason that, in the above embodiment, it is arranged by the operation of the third negative pressure switching valve 61 for the exhaust gas recirculation ratio to be reduced, in the range of engine revolution speed less than said second predetermined value, i.e. less than approximately 1200 rpm, below what it is when the engine revolution speed is greater than said second predetermined value. In the shown first preferred embodiment of the exhaust gas recirculation control system according to the present invention, the third negative pressure switching valve 61 is an ON/OFF switching valve, and has no intermediate position, and accordingly the performance of variation of exhaust gas recirculation ratio with respect to engine rotational speed, at any particular engine load, is a two valued performance only; but in other possible embodiments of the exhaust gas recirculation control system according to the present invention more delicate adjustment of the exhaust gas recirculation ratio with respect to engine speed, for a given engine load, could be performed—as for instance providing an intermediately varying amount of bled in atmospheric air to the intermediate portion of the negative pressure conduit 62, via a more sophisticated switching valve. This would still be within the scope of the present invention.

When the engine revolution speed is greater than 2800 rpm, then, as explained above, the first comparator 67 outputs an energization signal for the solenoid of the first negative pressure switching valve 59, which causes the first negative pressure switching valve 59 to connect the negative pressure conduit 62, via the air filter 66, to the atmosphere, and to disconnect said conduit 62 from the negative pressure conduit 58. Accordingly, no actuating negative pressure is in this condition supplied to the diaphragm chambers 22 and 30 of the first and second diaphragm actuated devices 20 and 28, and accordingly no exhaust gas recirculation takes place, beacuse the exhaust gas recirculation control valve 12 is substantially closed by the valve element 18 being biased against the valve seat 17 by the compression coil spring 23, and further the intake pipe 6 is substantially not throttled by the intake throttle valve 24. Similarly, when the temperature of the cooling water of the diesel internal combustion engine 1 is less than said certain predetermined value, then the second negative pressure switching valve 63 communicates the negative pressure conduit 64, via the air filter 74, to the atmosphere, and disconnects it from the negative pressure conduit 62, and accordingly the diaphragm chambers 22 and 30 of the first and second diaphragm actuated devices 20 and 28 are supplied with no actuating negative pressure, and accordingly no exhaust gas recirculation takes place through the exhaust gas recirculation control valve 12, and also the intake pipe 6 is not substantially throttled by the intake throttle valve 24.

The reason for not providing any exhaust gas recirculation in the high engine revolution speed range—in this embodiment when the engine revolution speed is greater than 2800 rpm—is so as to increase the reliability of the diesel internal combustion engine 1, and because exhaust gas recirculation in this operational range in any large quantity is not practicable, because the amount of excess air which is being taken into the combustion chambers 4 of the internal combustion engine 1 is not large, and therefore, in this operational region, the emission of nitrogen oxides by the diesel internal combustion engine 1 is not a great problem.

The reason for stopping exhaust gas recirculation when the temperature of the cooling water of the diesel internal combustion engine 1 is less than said certain predetermined value is in order to prevent corrosion of the diesel engine 1 and its accessories by sulphur compounds recirculated within the exhaust gas, when the engine is in the cold condition, which can present a serious problem. Thereby, the durability of the diesel internal combustion engine 1 is increased. Further, if exhaust gas recirculation is conducted when the internal combustion engine 1 is cold, its drivability is very seriously deteriorated.

Figure 4:
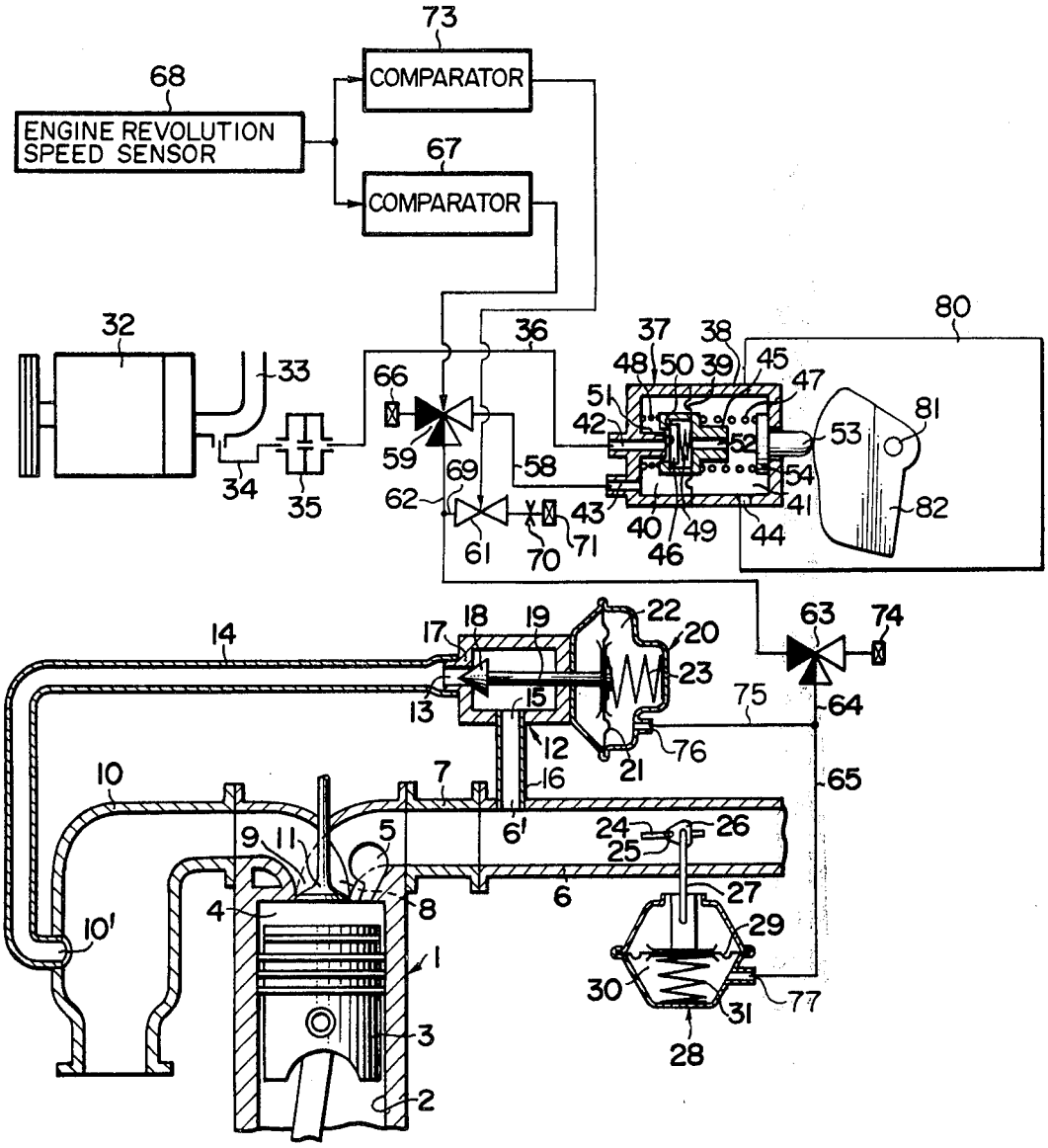
FIG. 4 is a simplified structural diagram, part sectional and part block diagrammatical, similar to FIG. 1, showing a second preferred embodiment of the exhaust gas recirculation control system for a diesel engine according to the present invention, which differs from the first preferred embodiment shown in FIGS. 1–3, in that in this second preferred embodiment a movable plunger projecting from said negative pressure control valve is driven by a cam which is connected to a rotary shaft of the fuel injection pump of the diesel engine, said cam being formed in a particular preferred shape.

In FIG. 4, a second preferred embodiment of the exhaust gas recirculation control system according to the present invention is shown. In this figure, parts which correspond to parts in the first preferred embodiment shown in FIG. 1, and which have the same functions, are designated by the same reference numerals as in that figure.

In this second preferred embodiment, the plunger 53 of the negative pressure control valve 37 is not driven by contact with any accelerator pedal link which rotates according to the amount of diesel fuel per injection being provided by the diesel fuel injection pump of the diesel internal combustion engine 1. On the contrary, the right hand end in FIG. 4 of the plunger 53 contacts the side of a cam 82 which is fixedly mounted on the control lever shaft 81 of the fuel injection pump 80. Of course, to this control lever shaft 81 of the diesel fuel injection pump 80 there is further mounted an actuating lever not shown in the drawing, which is rotated by a control linkage, also not shown in the drawing, according to the amount of depression of the accelerator pedal of the vehicle produced by the stepping on thereof by the driver, and thereby the diesel fuel injection pump 80 is caused to deliver an appropriate amount of diesel fuel per injection to the combustion chambers 4 of the internal combustion engine 1. Meanwhile, by the rotation of the above mentioned cam 82, the plunger 53 is driven to a greater or less amount leftwards in the drawing, and accordingly in the same way as mentioned above with reference to the first preferred embodiment of the exhaust gas recirculation control system according to the present invention shown in FIG. 1, produces an output negative pressure at its negative pressure output port 43 which varies according to the amount of this leftwards motion of the plunger 53.

Figure 5:
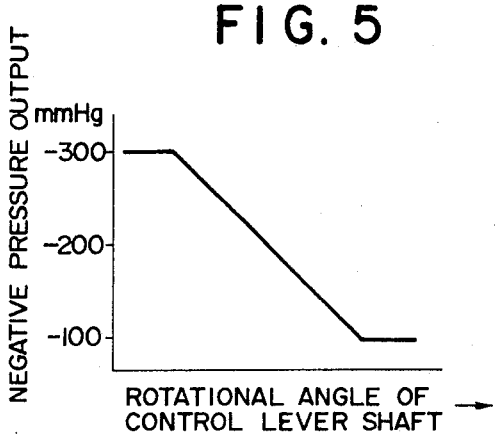
FIG. 5 is a graph, similar to FIG. 2, in which negative pressure is the ordinate, and rotational displacement of a control lever which actuates the above mentioned cam is the abscissa, in which the performance of variation of the negative pressure output from the negative pressure control valve in the second preferred embodiment of the exhaust gas recirculation control system for a diesel engine according to the present invention shown in FIG. 4, with respect to the rotation of the above mentioned cam, is shown.
Figure 6:
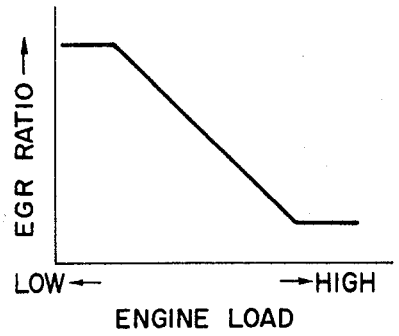
FIG. 6 is a graph, similar to FIG. 3, in which exhaust gas recirculation ratio is the ordinate, and engine load is the abscissa, showing the performance of variation of the exhaust gas recirculation ratio with respect to the engine load, in the second preferred embodiment of the exhaust gas recirculation control system for a diesel engine according to the present invention shown in FIG. 4.

In this embodiment, by varying the contour of the cam 82, the amount of axial displacement of the plunger 53 produced by rotation of the cam 82 through any given angle can be freely adjusted. In other words, the variation characteristic of the output negative pressure of the negative pressure control valve 37, with respect to angular rotation of the control lever shaft 81 of the fuel injection pump 80, i.e. with respect to engine load, may be freely adjusted according to design considerations for the internal combustion engine 1. For example, a cam shaped as shown in FIG. 4 may be used, which has: (a) a first cam portion of substantially constant smaller radius on its portion which contacts the plunger 53 when the amount of rotation (from its position wherein substantially zero fuel is being provided) of the control lever shaft of the diesel fuel injection pump 80 is relatively small, and accordingly the fuel injection pump 80 is only providing a small amount of diesel fuel to the combustion chambers 4 of the internal combustion engine 1, i.e., in the region of low engine load; (b) a second cam portion of a relatively steep slope on an intermediate portion of the cam 82, corresponding to an intermediate amount of rotation of the control lever shaft 81 of the fuel injection pump 80, i.e., corresponding to an intermediate range of engine load; and (c) a third portion of substantially constant larger radius at a portion of the cam 82 which corresponds to a relatively large amount of rotation of the control lever shaft 81 of the fuel injection pump 80, i.e. corresponding to a relatively large engine load range. With a cam of this shape, it is possible for the variation characteristic of the output negative pressure of the negative pressure control valve 37, produced at its negative pressure output port 43, with respect to the rotational angle of the control lever shaft 81 of the fuel injection pump 80, to be as shown in FIG. 5, in which said output negative pressure at the negative pressure output port 43 is shown as the ordinate, and the angle of rotation of said control lever shaft 81 is shown as the abscissa. Corresponding to this, the performance of the exhaust gas recirculation ratio with respect to engine load, in the vehicle operational condition when the temperature of the cooling water of the internal combustion engine 1 is greater than said certain predetermined value, and when the engine rotational speed is between 1200 and 2800 rpm, is as shown in FIG. 6, in which the exhaust gas recirculation ratio is shown as the ordinate, and the engine load is shown as the abscissa. Of course, in a fashion similar to the operation of the first preferred embodiment of the exhaust gas recirculation control system according to the present invention, when the engine rotational speed is less than 1200 rpm, then the performance of the exhaust gas recirculation ratio with respect to engine load will be indicated by a line of similar general shape to the solid line in FIG. 6, but somewhat displaced downwards therefrom towards the origin, similarly to the state of affairs illustrated in FIG. 3.

Figure 7:
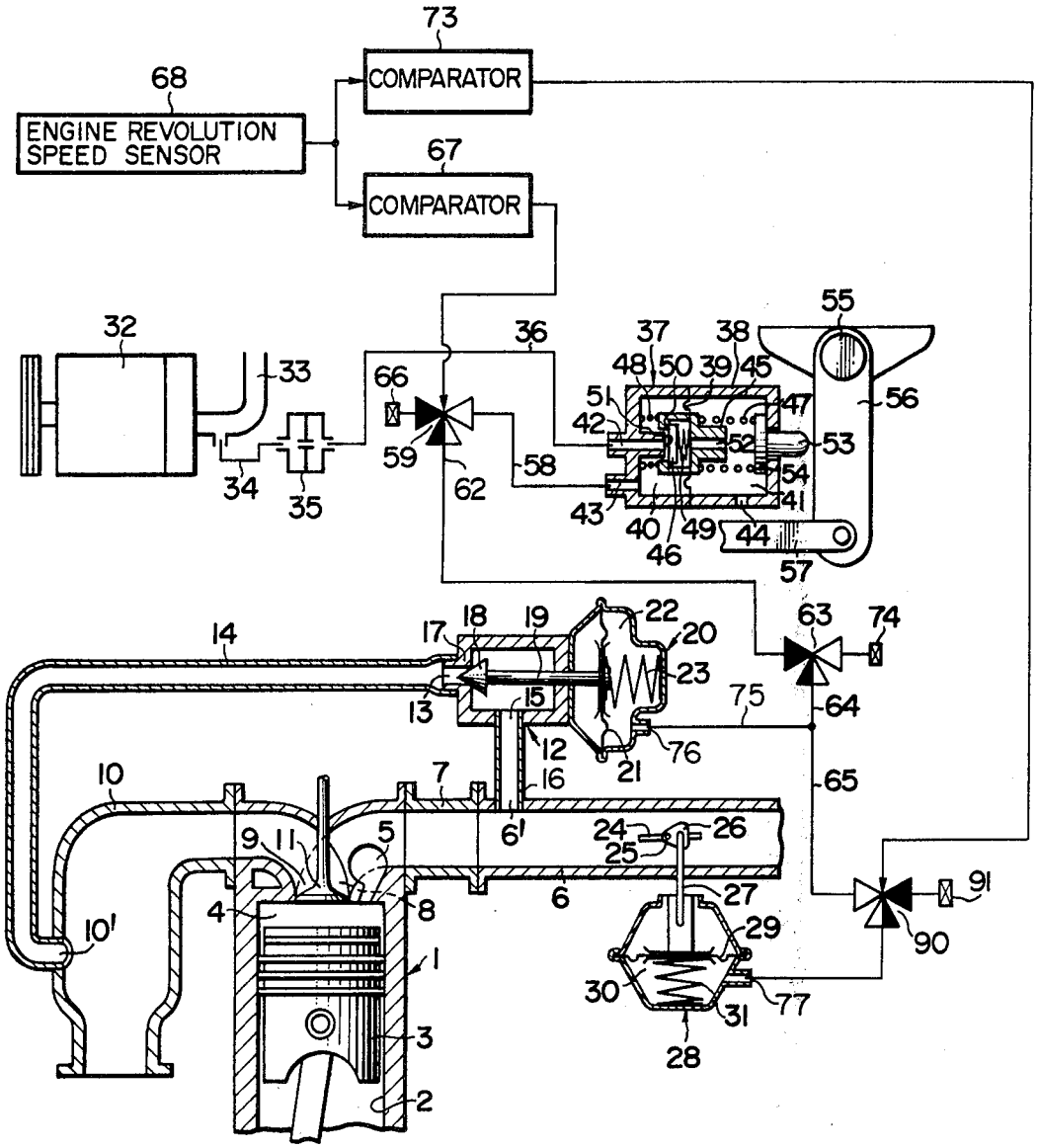
FIG. 7 is a simplified structural diagram, part cross sectional and part block diagrammatic, similar to FIGS. 1 and 4, showing a third preferred embodiment of the exhaust gas recirculation control system for a diesel engine according to the present invention, in which, as in the first preferred embodiment shown in FIG. 1, a plunger projecting from the negative pressure control valve bears against and is directly driven by an accelerator pedal link, but in which, instead of the air dilution system of the first preferred embodiment shown in FIGS. 1-3, a cut off valve is provided which cuts off supply of said controlling fluid pressure to a second diaphragm chamber of a diaphragm actuated device which controls a throttle valve mounted in the intake pipe of the diesel internal combustion engine, when the engine revolution speed is below said second predetermined value.

In FIG. 7, there is shown a third preferred embodiment of the exhaust gas recirculation control system for a diesel engine according to the present invention, in a fashion similar to FIGS. 1 and 4. In this third preferred embodiment, the mechanism for actuation of the plunger 53 so as to drive it leftwards in the drawing is the same as in the first preferred embodiment shown in FIG. 1; that is to say, the right hand end of the plunger 53 bears against an accelerator link 56 which is pivotally supported by a pivot 55, and which is rotated according to the amount of depression of the accelerator pedal of the vehicle produced by the driver stepping thereon, and which drives a fuel metering element of the fuel injection pump (not shown) via the rod 57. However, in this third preferred embodiment of the exhaust gas recirculation control system according to the present invention, the third negative pressure switching valve 61, the throttling means 70, and the air filter 71 coupled thereto, which in the first preferred embodiment provided a certain amount of atmospheric air as metered by the throttling element 70 to dilute or attenuate the negative pressure present within the negative pressure conduit 62 and so as to reduce the exhaust gas recirculation ratio, when the engine revolution speed was less than 1200 rpm, are not provided. Instead, the output signal of the second comparator 73, which, as explained above, is an energizing output signal when the revolution speed of the engine is less than 1200 rpm, is fed to a fourth negative pressure switching valve 90. The fourth negative pressure switching valve 90 is connected at an intermediate position in the negative pressure conduit 65 which leads to the negative pressure input port 77 of the second diaphragm actuated device 28 which operates the intake throttle valve 24. When a solenoid, not shown, incorporated in this fourth negative pressure switching valve 90 is not supplied with actuating electrical energy, the fourth negative pressure switching valve 90 communicates the negative pressure conduit 65 with the negative pressure conduit 92 so as to transmit actuating negative pressure to the diaphragm chamber 30 of the second diaphragm actuated device 28, while, when said solenoid is provided with supply of actuating electrical energy, it disconnects the negative pressure conduit 65 from the negative pressure conduit 92, and blocks the negative pressure conduit 65, instead connecting the conduit 92, via an air filter 91, to the atmosphere.

The operation of this third preferred embodiment of the exhaust gas recirculation control system for a diesel engine according to the present invention is as follows. When the rotational speed of the diesel internal combustion engine 1 is higher than 1200 rpm and less than 2800 rpm, and when the temperature of the cooling water thereof is also over said certain specified value, then, as in the previously explained first preferred embodiment of the present invention, the diaphragm chambers 22 and 30 of the first and second diaphragm actuated devices 20 and 28 both receive supply of negative pressure from the negative pressure output port 43 of the negative pressure control valve 37, said negative pressure being of a magnitude which, as explained above, corresponds to the amount of motion of the accelerator pedal link 56, which is connected to a fuel metering element of the diesel fuel injection pump of the engine 1, and in accordance therewith the exhaust gas recirculation control valve 12 and the intake throttle valve 24 are controlled by the first and second diaphragm actuated devices 20 and 28 in accordance with the value of this negative pressure. That is to say, as the load on the internal combustion engine 1 gradually becomes greater, the first diaphragm actuated device 20 gradually approached the valve element 18 to the valve seat 17 so as gradually to decrease the effective cross sectional opening area of the exhaust gas recirculation valve 12, and, in tandem with this, the second diaphragm actuated device 28 gradually drives the intake throttle valve 24 towards the more and more open position, so as gradually to increase the effective cross sectional opening area of the intake pipe 6. On the other hand, when engine load gradually decreases, the first diaphragm actuated device 20 gradually increases the effective cross sectional opening area of the exhaust gas recirculation control valve 12, and the second diaphragm actuated device 28 gradually reduces the effective cross sectional opening area of the intake pipe 6. Thus, in the same way as in the above described first preferred embodiment of the exhaust gas recirculation control system according to the present invention, the exhaust gas recirculation ratio is varied according to change in engine load in a way shown by the solid line in FIG. 3.

On the other hand, when the rotational speed of the internal combustion engine 1 is less than 1200 rpm, in this third preferred embodiment no diluting atmospheric air is injected into the negative pressure conduit 62 at an intermediate part thereof, as was the case in the first embodiment, because the structures associated with the third negative pressure switching valve 61 in the first preferred embodiment have been eliminated in this third preferred embodiment. In this third embodiment, when the engine rotational speed is less than 1200 rpm, provided of course that the temperature of the cooling water of the engine is greater than the aforesaid certain predetermined value, the diaphragm chamber 22 of the first diaphragm actuated device 20 continues to receive full supply of undiluted negative pressure via the negative pressure conduit 62 from the negative pressure output port 43 of the negative pressure control valve 37. On the other hand, the comparator 73, because the engine rotational speed is less than 1200 rpm, outputs at this time an energization signal which is received by the fourth negative pressure switching valve 90, causing the fourth negative pressure switching valve 90 to disconnect the negative pressure conduit 65 from the negative pressure conduit 92 and to block this negative pressure conduit 65, while connecting the negative pressure conduit 92 via the air filter 91 to the atmosphere and accordingly supplying air at atmospheric pressure to the diaphragm chamber 30 of the second diaphragm actuated device 28. In this condition, irrespective of the operation of the exhaust gas recirculation control valve 12, which as explained above is the same as in the operation of the first preferred embodiment when the engine rotational speed is between 1200 and 2800 rpm, the intake throttle valve 24 is kept in the full open position, because of this disablement of the function of the second diaphragm actuated device 28. Because of this, for the same engine load, the negative pressure in the intake tube 6 downstream of the intake throttle valve 24, i.e., in the vicinity of the exhaust gas injection port 6', is less than it was in the operation of the above described first embodiment, when the intake throttle valve 24 was reducing this effective cross sectional opening area in accordance with decrease in the engine load. As a result, for the same effective cross sectional opening area of the exhaust gas recirculation valve 12, less exhaust gas is recirculated through the exhaust gas recirculation conduits 14 and 16 to be supplied into the intake tube 6 through the exhaust gas injection port 6', because there is less negative pressure in the vicinity of said exhaust gas recirculation port 6' to suck said gas through the exhaust gas reciculation control valve 12. Thus, the exhaust gas recirculation ratio, for any given engine load, is reduced. Thus, the exhaust gas recirculation ratio has a performance of change with respect to the engine load as shown in FIG. 3 by the dashed line. In other words, the performance of variation of exhaust gas recirculation ratio with respect to engine load, and with respect to engine rotational speed, in this third preferred embodiment, is substantially the same as it was in the first embodiment, but is produced by a somewhat different structure.

Of course, in the same way as in the first preferred embodiment shown in FIG. 1, when the temperature of the cooling water of the internal combustion engine 1 is less than the aforementined predetermined value, then the second negative pressure switching valve 63, in this embodiment also, interrupts the communication between the negative pressure conduits 62 and 64, and accordingly no actuating negative pressure is supplied to the diaphragm chambers 22 and 30 of the first and second diaphragm actuated devices 20 and 28, and accordingly no exhaust gas is permitted to pass through the exhaust gas recirculation control valve 12, and the intake throttle valve 24 is kept at its maximum open condition by the operation of the second diaphragm operated device 28, and in this condition, as in the operation of the first and second preferred embodiments, no exhaust gas recirculation is performed, while the resistance to gas flow of the intake tube 6 is kept at its minimum.

Figure 8:
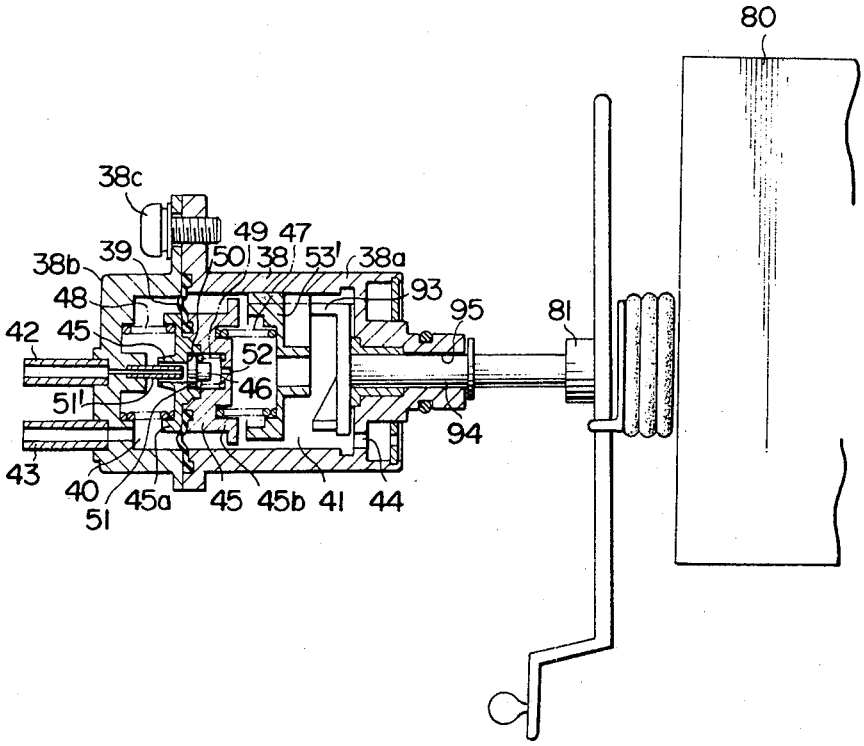
FIG. 8 is a cross sectional view, similar to portions of FIGS. 1, 4, and 7, showing an alternative construction for the negative pressure control valve, in which, instead of a plunger thereof projecting therefrom being axially driven, an end face cam is mounted within the body thereof and is rotationally driven by a rotational driving shaft of the fuel pump of the diesel engine.

In FIG. 8, an alternative possible construction for the negative pressure control valve 37 is shown in longitudinal cross section. In this construction, parts of the negative presure control valve 37 which correspond to like parts in the construction used in the first, second, and third embodiments of the exhaust gas recirculation control system according to the present invention shown in FIGS. 1, 4, and 7, and which have the same functions, are designated by the same reference numerals.

This negative pressure control valve 37 comprises a valve casing 38 which is formed from first and second valve casing portions 38*a* and 38*b*. The first valve casing portion 38*a* is on the right in FIG. 8, and the second valve casing portion 38*b* is on the left in FIG. 8. The two valve casing portions 38*a* and 38*b* are attached together by a plurality of screws 38*c* of which only one is visible in the drawing. In between the first and second casing portions 38*a* and 38*b* there is clamped a diaphragm member 39. As in the previous embodiments, a pressure chamber 40 is defined on the left side of the diaphragm 39 in the figure, and an atmospheric chamber 41 is defined on the right side of the diaphragm 39 in the figure. The atmospheric chamber 41 is vented to the atmosphere through an atmosphere release port 44. To the pressure chamber 40 there opens a negative pressure output port 43, and also a negative pressure input port 42 leads to a tubular projection 51 which projects within the pressure chamber 40 for a certain distance. To the diaphragm 39 there is fixed a valve shell member 45, which in this embodiment is formed of first and second valve shell member elements 45*a* and 45*b* which are clamped together and which grip the inner peripheral edge of the diaphragm 39, which is annular, between them. A compression coil spring 47 biases the valve shell member 45 to the left in the drawing, and a compression coil spring 48 biases the valve shell member 45 to the right in the drawing. The left hand end of the compression coil spring 48 bears against the fixed second casing portion 38*b* of the negative pressure control valve 37, while the right hand end in the drawing of the compression coil spring 47 bears against a sliding spring receiving member 53', which will be explained hereinafter, and therefore is moved leftwards and rightwards in the drawing by the movement of this sliding spring receiving member 53'.

Within the valve shell member 45, as in the previous embodiments, there is mounted a valve element 46 which is biased leftwards with respect to this valve shell member 45 by a compression coil spring 49. An axial hole 52 passes through the center of the valve shell member 45. In the position shown in the figure, wherein the end of the tubular projection 51 is not in contact with the valve element 46, the compression coil spring 49 biases the valve element 46 against the left hand end of a chamber within the valve shell element 45 within which said valve element 46 is housed, so as to interrupt the communication of the through hole 52 through the valve shell element 45, so that the pressure chamber 40 is not communicated with the atmoshperic chamber 41; while the opening in the end of the tubular projection 51 is open, because said end of the tubular projection 51 is not in contact with the valve element 46, and accordingly negative pressure can be introduced from the negative pressure input port 42 to the pressure chamber 40. Accordingly, by the action of the negative pressure pump 52, which is the same in this embodiment as in the other embodiments, the negative pressure within the pressure chamber 40 rises, and this rising negative pressure is also communicated to the negative pressure output port 43. On the other hand, if the valve shell element 45 moves leftwards in the drawing to a certain extent, so that the valve element 46 contacts the end of the tubular projection 51 and blocks the hole therein, while also this end of the tubular projection 51 similarly lifts the valve element 46 away from its contact with the left hand end of the cavity within the valve shell element 45 wherein said valve element 46 is housed, then in this condition the negative pressure supplied to the negative pressure input port 42 can no longer be introduced into the pressure chamber 40 from the hole in the end of the tubular projection 51, because this end is blocked by the valve element 46, while on the other hand the pressure chamber 40 is communicated with the atmospheric chamber 41 via the through hole 52 in the valve shell element 45 which is now open, past said valve element 46, and accordingly the negative pressure within the pressure chamber 40 is allowed to drop by being vented to the atmosphere chamber 41. By the previously explained balancing action of the movement of the diaphragm 39 and the valve shell element 45 coupled thereto leftwards and rightwards in the drawing, against and away from the end of the projecting tube 51, thereby the negative pressure within the negative pressure chamber 40 is maintained at a substantially constant value which is determined by the balance of the spring forces of the compression coil springs 47 and 48, and which accordingly depends on the position of the right hand end in the figure of the compression coil spring 47.

In this construction of the negative pressure control valve 47, as opposed to the previous construction, the right hand end of the compression coil spring 47 is not supported by any plunger such as the plunger 53 of the previous construction. Instead, the right hand end of the compression coil spring 47 is supported by a sliding spring receiving member 53', as already mentioned, which is mounted so as to be slidable along the axial direction of the compression coil spring 47, and which corresponds in function to the plunger 53 in the negative pressure control valve of the first type of construction as shown in FIGS. 1, 4, and 7. Further, the right hand end of the casing portion 38*a* in the drawing is formed with an axial hole 95 therethrough, in which there is rotatably received a driving shaft 94. On the left hand end in the figure of the driving shaft 94, within the negative pressure control valve 37, there is mounted an end face cam 93, which is engaged with the right hand side in the drawing of the sliding spring receiving member 53', the compression coil spring 47 biasing said sliding spring receiving member 53' against the operative portion of said end face cam 93, and therefore by the rotation of the cam driving shaft 94 the end face cam 93 is rotated, and propels the sliding spring receiving member 53 leftwards and rightwards in the figure so as to alter the compression force of the compression coil spring 47 and so as thereby to alter the equilibrium value of negative pressure maintained within the pressure chamber 40 and supplied to the negative pressure output port 43.

The right hand end in the figure of the cam driving shaft 94 is connected to the control lever shaft 81 of the diesel fuel injection pump 80 of the diesel internal combustion engine 1, and is rotated according to the rotation of this control lever shaft 81.

Accordingly , with the negative pressure control valve having the above modified construction, according to the amount of diesel fuel being provided by the fuel injection pump 80, i.e., according to the load on the diesel engine 1, the rotational positions of the control lever shaft 81, of the cam driving shaft 94, and of the end face cam 93 vary, and according to this the axial position of the sliding spring receiving member 53' varies in a fashion determined by the exact contour of the end faced cam 93, which need not be a linearly cut cam, but may be shaped in such a way, for example, as was the cam 82 in the second preferred embodiment of the exhaust gas recirculation control system for a diesel engine according to the present invention shown in FIG. 4. Thereby, substantially any desired performance of variation of the negative pressure present within the pressure chamber 40 of the negative pressure control valve 37 and outputed from the negative pressure output port 43 thereof, with respect to the engine load, i.e., with respect to the rotational angle of the control lever shaft 81, may be obtained.

The present invention is not limited to the forms of construction shown. As long as the member of the negative pressure control valve which determines the output negative pressure produced thereby is driven by a member which moves according to the amount of fuel injected per injection into the diesel internal combustion engine, then the means of this drive should not be considered as restricted to a simple accelerator link, nor as restricted to a cam mounted on the driving shaft of the fuel injection pump.

Nor should the present invention be considered as limited to the use of negative pressure or vacuum for driving the exhaust gas recirculation control valve. For example, the pump 32 could deliver positively pressurized fluid such as compressed air, which could be used in the operation of an alternative embodiment of the present invention as actuating fluid pressure for the first and second diaphragm actuated devices 20 and 28.

Accordingly, it is seen that according to the shown embodiments of the exhaust gas recirculation control system for a diesel engine according to the present invention, a practical and simple exhaust gas recirculation control system is provided, in which exhaust gases of said diesel engine are recirculated according to an exhaust gas recirculation ratio which corresponds to the engine load.

Further, it is seen that according to the present invention the variation of exhaust gas recirculation ratio with respect to engine load may be freely set to any desirable performance. This may be done by tailoring the contours of the cams comprised in the second embodiment of the exhaust gas recirculation control system according to the present invention, shown in FIG. 4, and in the second possible construction for the negative pressure control valve, shown in FIG. 8. Further, according to the present invention, it is seen that the variation of the exhaust gas recirculation ratio with respect to engine load can be simply modified according to various vehicle operational conditions, such as engine revolution speed, engine temperature, etc. This is done by the operation of the first, second, third, and fourth negative pressure switching valves, as shown in the first, second, and third preferred embodiments of the exhaust gas recirculation control system according to the present invention shown in FIGS. 1, 4 and 7. Of course, the shown criteria for control of these negative pressure switching switching valves, and their shown configurations, should not be considered as limitative of the present invention.

Further it is seen that, according to the present invention, because the actuating moving member of the negative pressure control valve need not be very large or heavy, and need not transmit a large force in order to control this negative pressure control valve, accordingly the exhaust gas recirculation control system according to the present invention does not need to impose a great driving load upon the accelerator pedal linkage of the diesel engine to which it is fitted, and accordingly the pleasantness of the driving feeling of the vehicle is not substantially deteriorated.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

I claim:

1. For a diesel internal combustion engine comprising:

(a) an air intake system;

(b) an exhaust system;

(c) an exhaust gas recirculation conduit, a first end of which is connected to said exhaust system and a second end of which is connected to an intermediate part of said air intake system, for recirculating exhaust gases from said exhaust system to said air intake system; and (d) a movable member which moves according to the amount of diesel fuel being supplied to said diesel internal combustion engine;

an exhaust gas recirculation control system, comprising:

(e) an exhaust gas recirculation control valve, comprising a first diaphragm chamber, provided in said exhaust gas recirculation conduit so as to regulate the flow of exhaust gas through said exhaust gas recirculation conduit, whose resistance to flow of exhaust gas varies according to the value of a controlling fluid pressure supplied to said first diaphragm chamber;

(f) a throttle valve fitted to said intake system upstream of said second end of said exhaust gas recirculation conduit;

(g) a fluid pressure control valve, which regulates a fluid pressure supply and produces said controlling fluid pressure, according to the amount of displacement of said movable member;

(h) a fluid pressure actuated diaphragm device, comprising a second diaphragm chamber which is supplied with said controlling fluid pressure from said fluid pressure control valve, which moves said throttle valve according to the value of said controlling fluid pressure;

whereby the amount of exhaust gas recirculation provided by said exhaust gas recirculation control valve is varied according to the amount of diesel fuel being supplied to said diesel internal combustion engine; and, by suitably tailoring the characteristics of said fluid pressure control valve with regard to the output controlling fluid pressure produced for a given amount of displacement of said movable member, the performance of exhaust gas recirculation provided by said exhaust gas recirculation control valve with respect to the amount of diesel fuel being provided to said diesel internal combustion engine may be suitably tailored; and whereby no great driving load need be put upon said movable member, such as would be imposed, if said movable member were directly mechanically coupled to a valve element of said exhaust gas recirculation control valve and said intake system throttle valve is moved so as to throttle said intake system more or less and thereby so as to produce more or less intake system vacuum in the neighborhood of said second end of said exhaust gas recirculation conduit, whereby exhaust gas recirculation through said exhaust gas recirculation conduit is desirably more or less promoted.

2. An exhaust gas recirculation control system according to claim 1, further comprising a means for cutting off supply of said controlling fluid pressure to said first diaphragm chamber of said exhaust gas recirculation control valve and to said second diaphragm chamber of said fluid pressure actuated diaphragm device, when the temperature of said diesel internal combustion engine is less than a certain specified value;

no exhaust gas recirculation being provided by said exhaust gas recirculation control valve, when said first diaphragm chamber of said exhaust gas recirculation control valve is not being provided with supply of said controlling fluid pressure;

and said intake system throttle valve being in its widest open position, when said second diaphragm chamber of said fluid pressure actuated diaphragm device is not being provided with supply of said controlling fluid pressure;

whereby, when the temperature of said diesel internal combustion engine is below said certain predetermined value and thus said diesel internal combustion engine has not fully warmed up, no exhaust gas recirculation is provided for said diesel internal combustion engine, and the intake passage thereof is not substantially throttled, whereby durability of said diesel internal combustion engine may be promoted.

3. An exhaust gas recirculation control system according to claim 1 or 2, further comprising a means for cutting off supply of said controlling fluid pressure to said first diaghragm chamber of said exhaust gas recirculation control valve and to said second diaphragm chamber of said fluid pressure actuated diaphragm device, when the rotational speed of said diesel internal combustion engine is greater than a first predetermined value;

no exhaust gas recirculation being provided by said exhaust gas recirculation control valve, when said first diaphragm chamber of said exhaust gas recirculation control valve is not being provided with supply of said controlling fluid pressure;

and said intake system throttle valve being in its widest open position, when said second diaphragm chamber of said fluid pressure actuated diaphragm device is not being provided with supply of said controlling fluid pressure;

whereby, when the rotational speed of said diesel internal combustion engine is greater than said first predetermined value, no exhaust gas recirculation is provided for said diesel internal combustion engine, and the intake passage thereof is not substantially throttled, whereby the drivability of said diesel internal combustion engine may be promoted.

4. An exhaust gas recirculation control system according to claim 3, further comprising a means for, when the rotational speed of said diesel internal combustion engine is less than a second predetermined value, reducing the effective value of said controlling fluid pressure which is being supplied to said first diaphragm chamber of said exhaust gas recirculation control valve and to said second diaphragm chamber of said fluid pressure actuated diaphragm device;

whereby, when the rotational speed of said diesel internal combustion engine is lower than said second predetermined value, for any given movement of said movable member, a relatively lower amount of exhaust gas recirculation is provided, than when the rotational speed of said diesel internal combustion engine is above said second predetermined value, so that the variation in the relation between the movement of said movable member and the amount of diesel fuel being supplied to said diesel internal combustion engine in low rotational speed operation is compensated for.

5. An exhaust gas recirculation control system according to claim 3, further comprising a means for cutting off supply of said controlling fluid pressure to said second diaphragm chamber of said fluid pressure actuated diaphragm device when the rotational speed of said diesel internal combustion engine is lower than a second predetermined value;

whereby, when the rotational speed of said diesel internal combustion engine is below said second predetermined value, said intake system throttle valve is at its most wide open position, whatever be the value of said controlling fluid pressure; and accordingly no additional inlet system vacuum is produced in the vicinity of said second end of said exhaust gas recirculation conduit by said intake system throttle valve being more closed by said fluid pressure actuated diaphragm device than its fully opened position; whereby, for any given movement of said movable member, when the rotational speed of said diesel internal combustion engine is below said second predetermined value, the exhaust gas recirculation ratio provided by said exhaust gas recirculation control system is relatively less, than when the rotational speed of said diesel internal combustion engine is greater than said second predetermined value, so that the variation in the relation between the movement of said movable member and the amount of diesel fuel being supplied to said diesel internal combustion engine in low rotational speed operation is compensated for.

6. An exhaust gas recirculation control system according to claim 1, wherein said fluid pressure control valve comprises:

(i) a diaphragm assembly;

(j) an atmospheric chamber, to which atmospheric air pressure is admitted, defined on one side of said diaphragm assembly;

(k) a negative pressure chamber, defined on the other side of said diaphragm assembly;

(l) a first compression coil spring, mounted within said negative pressure chamber, one end of which bears against said other side of said diaphragm assembly, while its other end bears against a fixed part of said fluid pressure control valve;

(m) a second compression coil spring, mounted within said atmospheric chamber, one end of which bears against said one side of said diaphragm assembly;

a negative pressure output port, which opens to said negative pressure chamber, and from which supply of said controlling fluid pressure, which is a negative pressure, is taken;

(n) an input port, which opens into said negative pressure chamber, comprising a first valve seat formed within said negative pressure chamber; and (o) a spring support member, which is movable in the axial direction of said second compression coil spring, and against which said other end of said second compression coil spring bears;

said diaphragm assembly comprising:

(p) a diaphragm; and (q) a communicating valve mounted on said diaphragm assembly and opposing said first valve seat formed on said negative pressure input port, and movable towards and away from said first valve seat by the flexing of said diaphragm; said communicating valve, when said communicating valve contacts said first valve seat, blocking said negative pressure input port and interrupting communication between said negative pressure input port and said negative pressure chamber, while said communicating valve simultaneously establishes communication between said negative pressure chamber and said atmospheric chamber; and said communicating valve, when said communicating valve is brought out of contact with said first valve seat formed on said negative pressure input port, interrupting communication between said negative pressure chamber and said atmospheric chamber, while said communicating valve simultaneously establishes communication between said negative pressure input port and said pressure chamber;

said fluid pressure supply, which is a supply of negative pressure, being provided to said negative pressure input port;

a value of negative pressure being established in said negative pressure chamber by said communicating valve being repeatedly brought into and out of contact with said first valve seat formed on said negative pressure input port, by the balance between the pressure difference within said negative pressure chamber and said atmospheric chamber, and the compression actions of said first and second compression coil springs, according to the position of said other end of said second compression coil spring;

whereby, as said spring support member is moved in the longitudinal direction of said second compression coil spring, said negative pressure value within said negative pressure chamber is varied.

7. An exhaust gas recirculation control system according to claim 6, wherein said communicating valve comprises a communicating valve casing formed with a through hole, a communicating valve element mounted within said through hole, and a third compression coil spring which biases said communicating valve element towards one end of said through hole, a constricted portion being formed at said one end of said through hole constituting a second valve seat against which said communicating valve element is biased by said third compression coil spring;

said first valve seat formed on said negative pressure input port, when it is approached towards said communicating valve, passing through said second valve seat so as to press said communicating valve element out of contact with said second valve seat so as to establish communication between said negative pressure chamber and said atmospheric chamber, while said communicating valve element at the same time contacts said first valve seat so as to block it and so as to interrupt communication between said negative pressure input port and said negative pressure chamber.

8. An exhaust gas recirculation control system according to claim 6 or claim 8, further comprising a cam which drives said spring support member to and fro in the axial direction of said second compression coil spring, said cam being rotated according to the movement of said movable member.

9. An exhaust gas recirculation control system according to claim 6 or claim 8, wherein said spring support member comprises a projection which projects in the direction away from said second compression coil spring out from the body of said fluid pressure control valve.

10. An exhaust gas recirculation control system according to claim 9, wherein said projection bears against said movable member.

11. An exhaust gas recirculation control system according to claim 8, wherein said cam is mounted outside said fluid pressure control valve, and wherein said spring support member comprises a projection which projects in the direction away from said compression coil spring out from the body of said fluid pressure control valve so as to bear against said cam.

12. An exhaust gas recirculation control system according to claim 8, wherein said cam is mounted within said fluid pressure control valve, and further comprising a cam drive shaft which projects out from the body of said fluid pressure control valve so as to be driven by said movable member.

13. An exhaust gas recirculation control system according to claim 11, wherein said cam is a radial cam.

14. An exhaust gas recirculation control system according to claim 12, wherein said cam is an end face cam.

15. An exhaust gas recirculation control system according to claim 13, wherein said cam is formed with a first cam portion of relatively moderate slope and generally smaller radius on its portion which operates to position said spring support member when only a small amount of diesel fuel is being provided to said diesel internal combustion engine, so that at this time said second compression coil spring is compressed relatively little; a second cam portion of a relatively steep slope on its portion which operates to position said spring support member when an intermediate amount of diesel fuel is being provided to said diesel internal combustion engine, so that at this time said second compression coil spring is being compressed to an intermediate degree; and a third cam portion of relatively moderate slope and of generally larger radius on its portion which operates to position said spring support member when a large amount of diesel fuel is being provided to said diesel internal combustion engine, so that at this time said second compression coil spring is being relatively strongly compressed.

16. An exhaust gas recirculation control system according to claim 14, wherein said cam is formed with a first cam portion of relatively moderate slope and generally smaller lift on its portion which operates to position said spring support member when only a small amount of diesel fuel is being provided to said diesel internal combustion engine, so that at this time said second compression coil spring is compressed relatively little; a second cam portion of a relatively steep slope on its portion which operates to position said spring support member when an intermediate amount of diesel fuel is being provided to said diesel internal combustion engine, so that at this time said second compression coil spring is being compressed to an intermediate degree; and a third cam portion of relatively moderate slope and of generally larger lift on its portion which operates to position said spring support member when a large amount of diesel fuel is being provided to said diesel internal combustion engine, so that at this time said second compression coil spring is being relatively strongly compressed.

* * * * *